US011634289B2

(12) United States Patent
Haruta

(10) Patent No.: US 11,634,289 B2
(45) Date of Patent: Apr. 25, 2023

(54) IMAGE-FORMING APPARATUS HAVING ELECTROMAGNETIC CLUTCH FOR TRANSMITTING DRIVE FORCE OF MOTOR TO CONVEYING ROLLER

(71) Applicant: BROTHER KOGYO KABUSHIKI KAISHA, Nagoya (JP)

(72) Inventor: Kotaro Haruta, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 255 days.

(21) Appl. No.: 17/073,947

(22) Filed: Oct. 19, 2020

(65) Prior Publication Data

US 2021/0130117 A1 May 6, 2021

(30) Foreign Application Priority Data

Nov. 6, 2019 (JP) ..... JP2019-201794

(51) Int. Cl.
*B65H 5/06* (2006.01)
*B65H 5/34* (2006.01)
(Continued)

(52) U.S. Cl.
CPC ..... *B65H 5/062* (2013.01); *B41J 13/0018* (2013.01); *B41J 13/0054* (2013.01); *B41J 13/03* (2013.01); *G03G 15/6529* (2013.01); *B65H 2403/724* (2013.01); *B65H 2511/11* (2013.01); *B65H 2801/06* (2013.01)

(58) Field of Classification Search
CPC .... B65H 5/34; B65H 5/062; B65H 2403/724; B65H 2513/512; B65H 2511/11; B41J 13/0018; B41J 13/0054; B41J 13/03; G03G 15/6529; G03G 15/6564; G03G 2215/00734
See application file for complete search history.

(56) References Cited

U.S. PATENT DOCUMENTS 5,669,039 A * 9/1997 Ohtsuka ..... G03G 15/2042 399/68
5,838,591 A 11/1998 Yamaguchi
(Continued)

FOREIGN PATENT DOCUMENTS

JP S62-093153 A 4/1987
JP H10-014096 A 1/1998
(Continued)

*Primary Examiner* — Luis A Gonzalez
(74) *Attorney, Agent, or Firm* — Baker Botts L.L.P.

(57) ABSTRACT

In an image-forming apparatus, when a sheet length of a first sheet is shorter than or equal to a predetermined length, a controller supplies power to an electromagnetic clutch to convey the first sheet and a second sheet so that a sheet gap of the second sheet is equivalent to a first gap. When the sheet length of the first sheet is longer than the predetermined length, the controller supplies power to the electromagnetic clutch to successively convey a first number of sheets so that the sheet gap of each of the first number of sheets is equivalent to the first gap. After the first number of sheets has been conveyed, the controller supplies power to the electromagnetic clutch to convey at least one sheet so that the sheet gap of each of the at least one sheet is equivalent to a second gap greater than the first gap.

10 Claims, 4 Drawing Sheets

(51) Int. Cl.

| | |
|---|---|
| ***G03G 15/00*** | (2006.01) |
| ***B41J 13/03*** | (2006.01) |
| ***B41J 13/00*** | (2006.01) |

(56) References Cited

U.S. PATENT DOCUMENTS

| | | | | |
|---|---|---|---|---|
| 2011/0262165 | A1 | 10/2011 | Takeuchi et al. | |
| 2014/0064753 | A1 | 3/2014 | Saeki | |
| 2018/0198943 | A1* | 7/2018 | Yoshi | H04N 1/047 |
| 2019/0100398 | A1* | 4/2019 | Nakayoshi | H04N 1/00713 |
| 2020/0385226 | A1* | 12/2020 | Hishinuma | G03G 15/6564 |
| 2021/0072683 | A1* | 3/2021 | Yoshida | G03G 15/205 |

FOREIGN PATENT DOCUMENTS

| | | | | |
|---|---|---|---|---|
| JP | 2009-031580 | A | | 2/2009 |
| JP | 2010-134407 | A | | 6/2010 |
| JP | 2011-232532 | A | | 11/2011 |
| JP | 2013-225108 | A | | 10/2013 |
| JP | 2014-048395 | A | | 3/2014 |
| JP | 2018063395 | A | * | 4/2018 |
| JP | 2018-160994 | A | | 10/2018 |

* cited by examiner

IMAGE-FORMING APPARATUS HAVING ELECTROMAGNETIC CLUTCH FOR TRANSMITTING DRIVE FORCE OF MOTOR TO CONVEYING ROLLER

CROSS REFERENCE TO RELATED APPLICATION

This application claims priority from Japanese Patent Application No. 2019-201794 filed Nov. 6, 2019. The entire content of the priority application is incorporated herein by reference.

TECHNICAL FIELD

The present disclosure relates to an image-forming apparatus that conveys sheets by supplying power to an electromagnetic clutch in order to transmit a drive force of a motor to conveying rollers and a sheet conveying method for conveying sheets in the image-forming apparatus.

BACKGROUND

A conventional image-forming apparatus known in the art has registration rollers for correcting skew in sheets, and an electromagnetic clutch to start and stop rotation of the registration rollers. In this apparatus, the registration rollers are rotated by supplying power to the electromagnetic clutch.

SUMMARY

While the electromagnetic clutch in such conventional apparatuses is actuated to rotate registration rollers or other conveying rollers for conveying sheets, the temperature of the electromagnetic clutch rises. If a plurality of sheets is being printed consecutively, a prescribed gap must be maintained between conveyed sheets. Consequently, the ratio of time during which sheets are conveyed differs according to the length of sheet. Specifically, the duration that conveying rollers are rotated increases when printing long sheets consecutively. Thus, when printing long sheets consecutively, the actuating time of the electromagnetic clutch becomes longer, increasing the likelihood of the electromagnetic clutch overheating.

In view of the foregoing, it is an object of the present disclosure to provide an image-forming apparatus that can prevent overheating of an electromagnetic clutch.

In order to attain the above and other objects, the present disclosure provides an image-forming apparatus including: a motor; a conveying roller; an image-forming portion; an electromagnetic clutch; and a controller. The conveying roller is configured to convey a sheet in a conveying direction upon receipt of a drive force of the motor. The image-forming portion is configured to form an image on the sheet conveyed by the conveying roller. The electromagnetic clutch is configured to transmit the drive force of the motor to the conveying roller upon receipt of power. The controller is configured to: successively convey a plurality of sheets to the image-forming portion; and form an image on each of the plurality of sheets. The plurality of sheets includes a first sheet and a second sheet to be successively conveyed to the image-forming portion following the first sheet. In a case where a sheet length of the first sheet is shorter than or equal to a predetermined length, the controller supplies power to the electromagnetic clutch to convey the first sheet and the second sheet to the image-forming portion so that a sheet gap in the conveying direction of the second sheet is equivalent to a first gap. The sheet gap of one sheet is a space formed between a trailing end of a previous sheet and a leading end of the one sheet. The previous sheet is successively conveyed prior to the one sheet. In a case where the sheet length of the first sheet is longer than the predetermined length: the controller supplies power to the electromagnetic clutch to successively convey a first number of sheets starting from the first sheet to the image-forming portion so that the sheet gap of each of the first number of sheets is equivalent to the first gap; and after the first number of sheets has been conveyed to the image-forming portion, the controller supplies power to the electromagnetic clutch to convey at least one sheet to the image-forming portion so that the sheet gap of each of the at least one sheet is equivalent to a second gap greater than the first gap.

According to another aspect, the present disclosure provides a sheet conveying method for conveying a plurality of sheets including a first sheet in an image-forming apparatus. The sheet conveying method includes: when a length of the first sheet is shorter than or equal to a predetermined length: conveying the plurality of sheets such that a sheet gap between a trailing end of a previous sheet and a leading end of a subsequent sheet is equivalent to a first gap, the subsequent sheet being successively conveyed following the previous sheet; when the length of the first sheet is longer than the predetermined length: conveying a predetermined number of sheets such that the sheet gap is equivalent to the first gap; and after conveying the predetermined number of sheets, successively conveying one or more sheets such that the sheet gap is equivalent to a second gap longer than the first gap.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
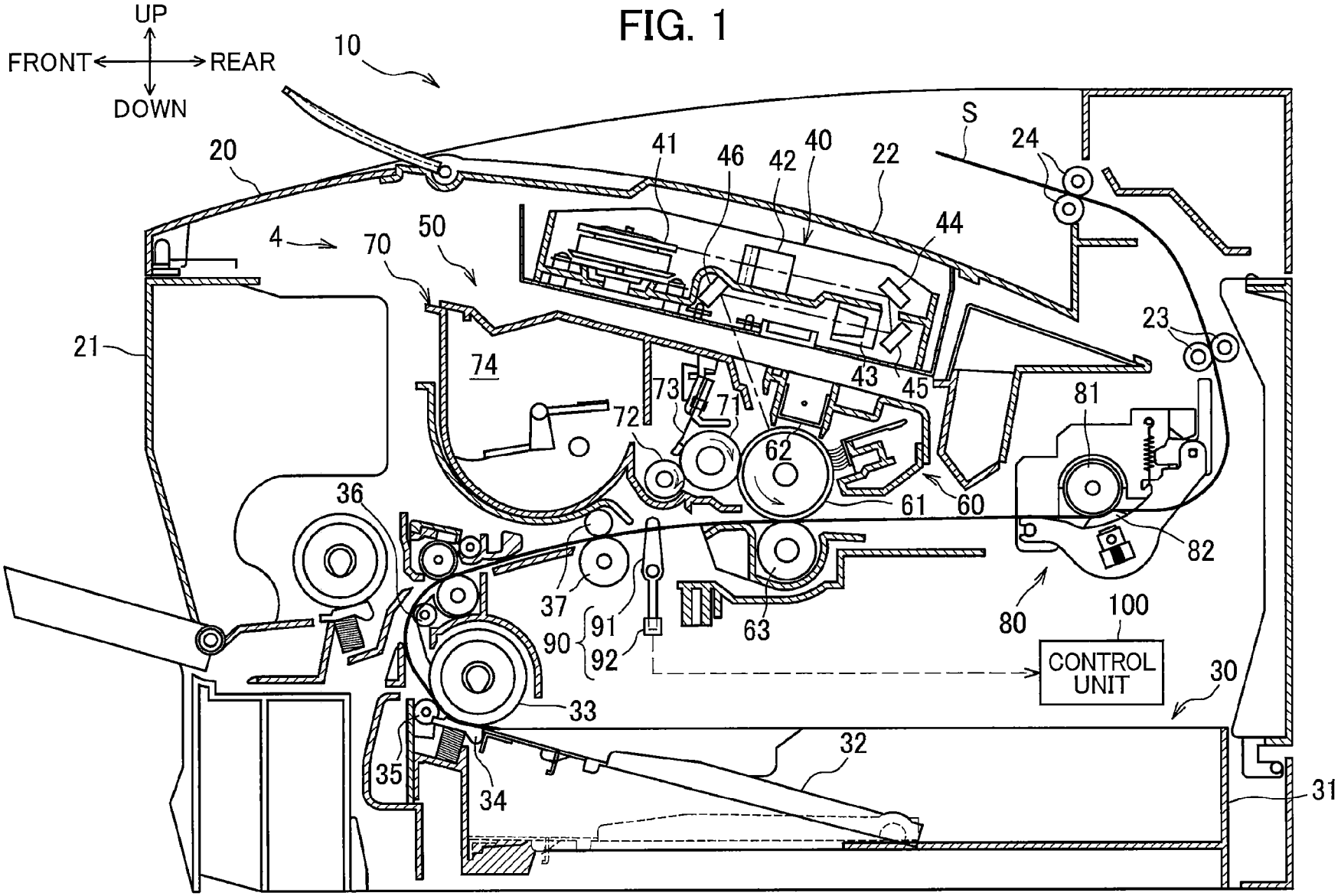
FIG. 1 is a diagram illustrating the schematic configuration of an image-forming apparatus according to one embodiment of the present disclosure.

Next, an image-forming apparatus 10 according to one embodiment will be described while referring to the accompanying drawings. In the following description, unless otherwise noted, the vertical (up and down) directions illustrated in FIG. 1 will be called the vertical (up and down) directions. Further, the right side in FIG. 1 will be called the rear, the left side will be called the front, the near side in the drawing will be called the right, and the far side will be called the left.

As illustrated in FIG. 1, the image-forming apparatus 10 includes a main casing 20. Within the main casing 20, the image-forming apparatus 10 is primarily provided with a sheet-feeding unit 30 for supplying sheets S, an image-forming unit 4 for forming images on the sheets S, and a control unit 100. The image-forming unit 4 is an example of the image-forming portion of the present disclosure, and the control unit 100 is an example of the controller of the present disclosure.

The sheet-feeding unit 30 is provided in the bottom section of the main casing 20. The sheet-feeding unit 30 is primarily provided with a paper tray 31 that accommodates sheets S, a paper-pressing plate 32 that lifts up the front side of the sheets S, a feed roller 33, a separating pad 34, paper-dust rollers 35 and 36, and a pair of registration rollers 37. The registration rollers 37 are an example of the conveying rollers that convey sheets S in the image-forming unit 4. Sheets S in the paper tray 31 are urged toward the feed roller 33 by the paper-pressing plate 32. The feed roller 33 and separating pad 34 separate the sheets S one at a time, and the paper-dust rollers 35 and 36 and registration rollers 37 convey the sheets S toward a process cartridge 50 (described later). The registration rollers 37 correct skew in a conveyed sheet S when the leading edge of the sheet S comes into contact with the registration rollers 37. Further, by rotating, the registration rollers 37 convey the sheet S. The registration rollers 37 are an example of the conveying roller of the present disclosure.

A sheet sensor 90 is disposed downstream of the registration rollers 37 in the conveying direction of the sheet S. The sheet sensor 90 detects when a sheet S passes. The sheet sensor 90 has an actuator 91, and a photosensor 92. The actuator 91 pivots when contacted by a sheet S as the sheet S passes the sheet sensor 90. The photosensor 92 detects movement of the actuator 91. The sheet sensor 90 is an example of the sensor of the present disclosure.

The image-forming unit 4 has an exposure device 40, the process cartridge 50 for transferring toner images onto sheets S, and a fixing device 80 for thermally fixing the toner images to the sheets S.

The exposure device 40 is disposed in the top section of the main casing 20. The exposure device 40 is primarily provided with a laser light-emitting unit (not illustrated), a polygon mirror 41 that is driven to rotate, lenses 42 and 43, and reflecting mirrors 44, 45, and 46. With this exposure device 40, a laser beam emitted from the laser light-emitting unit is sequentially reflected off or transmitted through the polygon mirror 41, lens 42, reflecting mirror 44, reflecting mirror 45, lens 43, and reflecting mirror 46, and scanned at a high speed over the surface of a photosensitive drum 61 (described later).

The process cartridge 50 is detachably mounted in the main casing 20 at a position beneath the exposure device 40. Specifically, a front cover 21 is provided on the main casing 20 to cover an opening through which the process cartridge 50 is mounted and removed. Thus, the process cartridge 50 can be mounted in the main casing 20 when the front cover 21 is opened. The process cartridge 50 is configured of a drum unit 60, and a developing unit 70.

The drum unit 60 is primarily provided with the photosensitive drum 61, a charger 62, and a transfer roller 63. The developing unit 70 is detachably mounted in the drum unit 60. The developing unit 70 is primarily provided with a developing roller 71, a supply roller 72, a thickness-regulating blade 73, and a toner-accommodating section 74 that holds toner.

In the process cartridge 50 having the above configuration, the charger 62 applies a uniform charge to the surface of the photosensitive drum 61. Subsequently, the exposure device 40 exposes the surface of the photosensitive drum 61 with a laser beam scanned at a high speed, forming an electrostatic latent image on the photosensitive drum 61. In the meantime, toner in the toner-accommodating section 74 is supplied onto the developing roller 71 via the supply roller 72. The toner carried on the developing roller 71 passes underneath the thickness-regulating blade 73, which regulates the layer of toner to a uniform thickness.

The toner carried on the developing roller 71 is supplied from the developing roller 71 to the electrostatic latent image formed on the photosensitive drum 61. In this way, the latent image on the photosensitive drum 61 is developed into a visible toner image. Subsequently, the toner image carried on the surface of the photosensitive drum 61 is transferred onto a sheet S as the sheet S is conveyed between the photosensitive drum 61 and transfer roller 63.

The fixing device 80 is disposed to the rear of the process cartridge 50. The fixing device 80 has a heating member 81, and a pressure member 82 that presses the sheet S against the heating member 81. When a sheet S passes through the fixing device 80 after a toner image has been transferred onto the sheet S, the heating member 81 and pressure member 82 thermally fix the toner image to the sheet S. After the fixing operation, conveying rollers 23 and 24 disposed in the main casing 20 downstream of the fixing device 80 discharge the sheet S into a discharge tray 22 formed on the top surface of the main casing 20.

Figure 2:
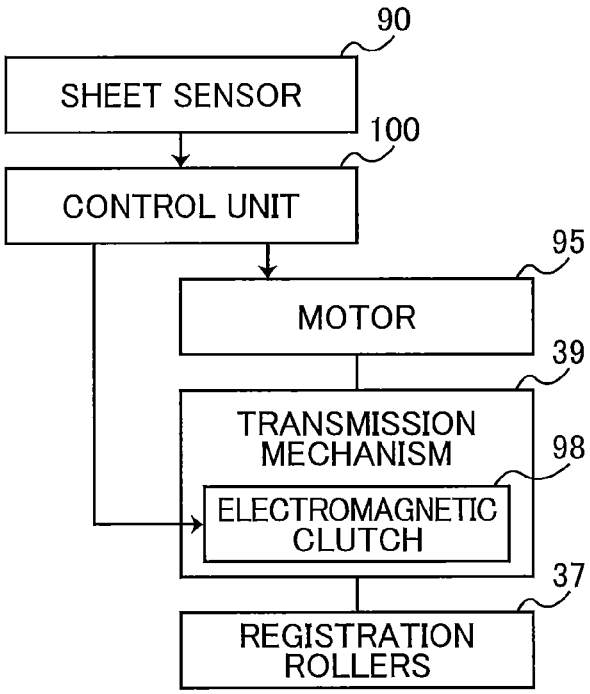
FIG. 2 is a block diagram illustrating a structure for controlling conveyance of sheets in the image-forming apparatus according to the embodiment of the present disclosure.

Next, the structure for controlling the conveyance of sheets S will be described. As illustrated in FIG. 2, the image-forming apparatus 10 also has a motor 95 for conveying sheets S, and an electromagnetic clutch 98. The motor 95 is an example of the motor of the present disclosure, and the electromagnetic clutch 98 is an example of the electromagnetic clutch of the present disclosure.

The motor 95 is coupled to the registration rollers 37 via a transmission mechanism 39. The transmission mechanism 39 is configured of a plurality of gears and the like.

The electromagnetic clutch 98 is provided in the transmission mechanism 39. The electromagnetic clutch 98 includes a coil (not illustrated) for engaging and disengaging the transmission of the drive force of the motor 95. The electromagnetic clutch 98 transmits the drive force of the motor 95 to the registration rollers 37 when actuated and does not transmit the drive force when not actuated. More specifically, the electromagnetic clutch 98 transmits the drive force of the motor 95 to the registration rollers 37 when the coil is supplied with power and does not transmit the drive force when the coil is not supplied with power. The coil generates heat while being supplied with power.

The control unit 100 receives signals from the sheet sensor 90. In response to the signals received from the sheet sensor 90, the control unit 100 can determine the timing at which the leading edge of a sheet S conveyed by the registration rollers 37 contacts the actuator 91 of the sheet sensor 90, and the timing at which the trailing edge of the sheet S passes the actuator 91. From the signals received from the sheet sensor 90, the control unit 100 can determine the length of time required for the sheet S to pass over the sheet sensor 90 and, using this time and the conveying speed of the sheet S, can calculate a length Ls of the sheet S. Thereafter, when a print job is received, the control unit 100 controls the sheet-feeding unit 30 to convey sheets S on the basis of the length Ls of the sheet S.

Specifically, when the length Ls of the sheet S is no greater than a prescribed length equivalent to the long side of an A4-size sheet (297 mm) and when a plurality of sheets S are to be printed consecutively, the control unit 100 supplies power to the electromagnetic clutch 98 so that a sheet gap between successively fed sheets S is a first gap T1. Here, the sheet gap denotes the spacing formed between consecutive sheets S conveyed through the image-forming unit 4. The process for conveying and printing sheets S of the prescribed length or shorter will be called a "normal printing process." The prescribed length is an example of the prescribed length of the present disclosure. The first gap T1 is an example of the first gap of the present disclosure.

When the length Ls of the sheet S is longer than the prescribed length, the control unit 100 supplies power to the electromagnetic clutch 98 so that the sheet gap is the first gap T1 until a first number N1 of sheets S has been conveyed. After the first number N1 of sheets S has been conveyed, the control unit 100 supplies power to the electromagnetic clutch 98 so that the sheet gap is a second gap T2 greater than the first gap T1 for at least one sheet. The process for conveying and printing sheets S that are longer than the prescribed length will be called a "long sheet printing process." The second gap T2 is an example of the second gap of the present disclosure.

Here, the first number N1 of sheets S is not limited to any particular number, but may be optionally set to fifty, one-hundred, or five-hundred sheets, for example. The first gap T1 is preferably set to the shortest sheet gap that the image-forming apparatus 10 can control. In the following description, sixty will be used as an example of the first number N1 of sheets S. The first number N1 of sheets S is an example of the first number of sheets of the present disclosure.

When printing a plurality of sheets S consecutively, if the control unit 100 first determines that the length Ls of the sheet S is no greater than the prescribed length and subsequently determines that the length Ls of another (subsequently conveyed) sheet S is longer than the prescribed length, the control unit 100 continues conveying sheets S with the first gap T1 as the sheet gap until the first number N1 of sheets S has been conveyed. After the first number N1 of sheets S has been conveyed, the control unit 100 supplies power to the electromagnetic clutch 98 so that the sheet gap becomes the second gap T2 (greater than the first gap T1) for at least one sheet S. Hence, if the control unit 100 detects a sheet S that is longer than the prescribed length while executing a normal printing process, the control unit 100 subsequently transitions to the long sheet printing process.

In the present embodiment, if the length Ls of sheets S is longer than the prescribed length, the control unit 100 first conveys the first number N1 of sheets S by controlling the electromagnetic clutch 98 so that the sheet gap is the first gap T1, and subsequently controls the electromagnetic clutch 98 to convey all remaining sheets S so that the sheet gap is the second gap T2.

The control unit 100 switches the sheet gap between the first gap T1 and second gap T2 by controlling the timing of supplying power to the electromagnetic clutch 98, i.e., the timing at which the electromagnetic clutch 98 is actuated. With this configuration, the quantity of dissipated heat in the electromagnetic clutch 98 per unit time is less when sheets S are conveyed to and through the image-forming unit 4 spaced at the second gap T2 than when sheets S are conveyed to and through the image-forming unit 4 spaced at the first gap T1.

More specifically, the registration rollers 37 in the image-forming apparatus 10 according to the present embodiment rotate while the electromagnetic clutch 98 is actuated. Accordingly, when the sheet gap is constant, the length of time that the electromagnetic clutch 98 is actuated is longer when the length of the sheets S is longer. As an example, if the sheet gap is the first gap T1 and the length of the sheet S is L1, the time ratio for supplying power to the electromagnetic clutch 98 (the duty cycle D in this case) is D=L1/(L1+T1). This equation will be called Equation (1). If the length of the sheet S is L2, which is greater than L1, then D=L2/(L2+T1). This equation will be called Equation (2). By comparing Equations (1) and (2), it is clear that the duty cycle D is greater for longer sheets S when the sheet gap is fixed at the first gap T1. Hence, when the sheet gap is constant, the amount of heat dissipated in the electromagnetic clutch 98 per unit time is greater for longer sheets S. Note that "unit time" in this case is a long time sufficient for printing a plurality of sheets S.

On the other hand, if the length of the sheet S is fixed at L2 but the sheet gap is changed to T2, the duty cycle D is D=L2/(L2+T2). This equation will be called Equation (3). By comparing Equations (2) and (3), it is clear that the duty cycle D decreases as the sheet gap increases when the length of the sheets S is fixed at L2. Therefore, since the duty cycle D for supplying power to the electromagnetic clutch 98 decreases as the sheet gap is increased if the length of the sheets S is constant, the quantity of heat dissipated in the electromagnetic clutch 98 per unit time decreases.

Next, an example of a control process implemented by the control unit 100 having the above configuration will be described with reference to the flowcharts in FIGS. 3 through 5.

Figure 3:
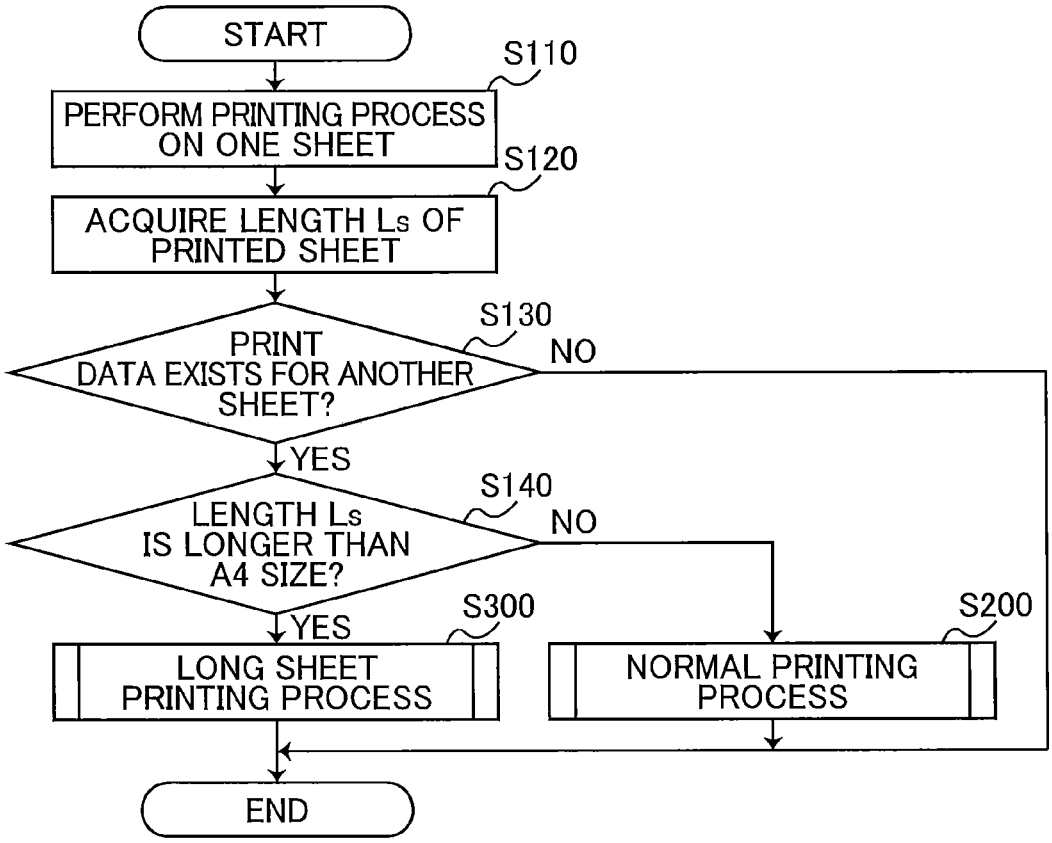
FIG. 3 is a flowchart illustrating steps in a control process implemented by a control unit of the image-forming apparatus according to the embodiment of the present disclosure when receiving a print job.

The process in FIG. 3 begins when the control unit 100 receives a print job. In S110 of FIG. 3, the control unit 100 performs a printing process on one sheet. In S120 the control unit 100 acquires the length Ls of the printed sheet S according to signals received from the sheet sensor 90 during the printing process. In S130 the control unit 100 determines whether print data exists for another sheet.

If the control unit 100 determines that print data does not exist for another sheet (S130: NO), the control unit 100 ends the control process. However, if the control unit 100 determines that print data for other sheets exists (S130: YES), in S140 the control unit 100 determines whether the length Ls of the sheet acquired in S120 is longer than the long side in A4 size.

The control unit 100 executes the normal printing process in S200 when determining that the length Ls acquired in S120 is not longer than the long side in A4 size (S140: NO) and executes the long sheet printing process in S300 when determining that the length Ls is longer than the long side in A4 size (S140: YES). After completing the normal printing process in S200 or the long sheet printing process in S300, the control unit 100 ends the control process in FIG. 3.

Figure 4:
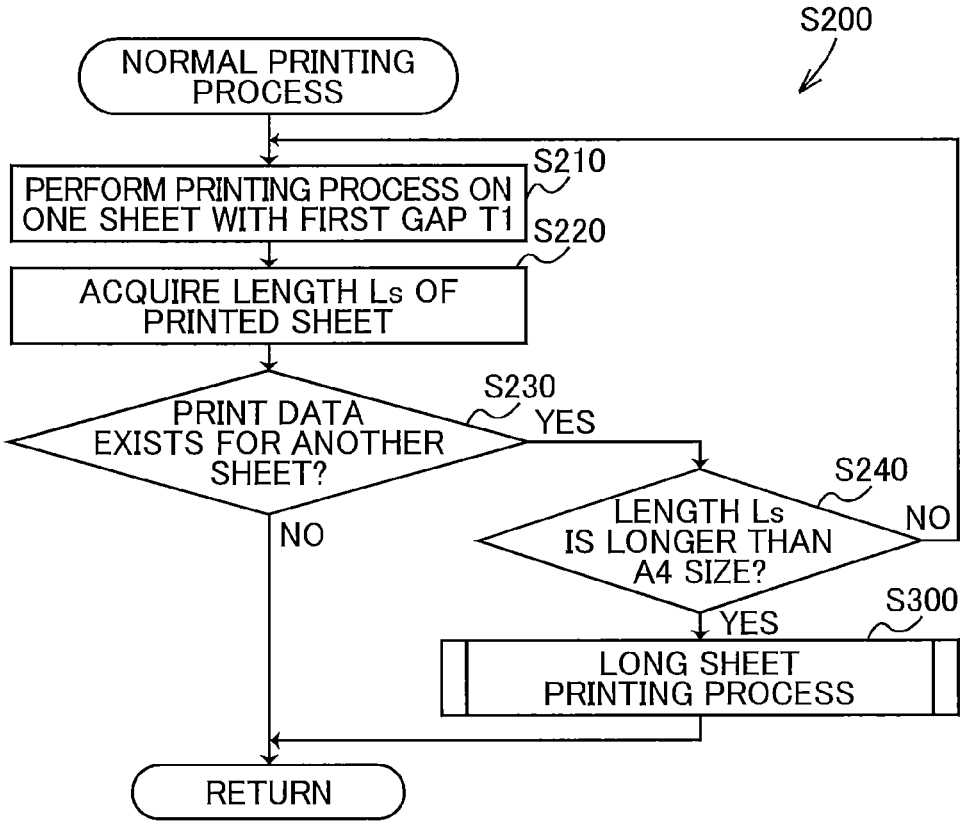
FIG. 4 is a flowchart illustrating steps in a normal printing process executed by the control unit of the image-forming apparatus according to the embodiment of the present disclosure.

FIG. 4 illustrates steps in the normal printing process of S200. In S210 of the normal printing process, the control unit 100 executes a printing process on one sheet S while controlling the electromagnetic clutch 98 so that the sheet gap between the leading edge of the current sheet and the trailing edge of the previously printed sheet is equivalent to the first gap T1. In S220 the control unit 100 acquires the length Ls of the current sheet S.

In S230 the control unit 100 determines whether print data exists for another sheet. If the control unit 100 determines that no print data remains (S230: NO), the control unit 100 ends the normal printing process. However, if the control unit 100 determines that print data exists for other sheets (S230: YES), in S240 the control unit 100 determines whether the length Ls acquired in S220 is longer than the long side in the A4 size.

If the control unit 100 determines that the length Ls is not longer than the long side in A4 size (S240: NO), the control unit 100 returns to S210 and repeats the printing process for the next sheet. However, if the control unit 100 determines that the length Ls acquired in S220 is longer than the long side in A4 size (S240: YES), the control unit 100 transitions to the long sheet printing process of S300. After completing the long sheet printing process of S300, the control unit 100 ends the normal printing process.

Figure 5:
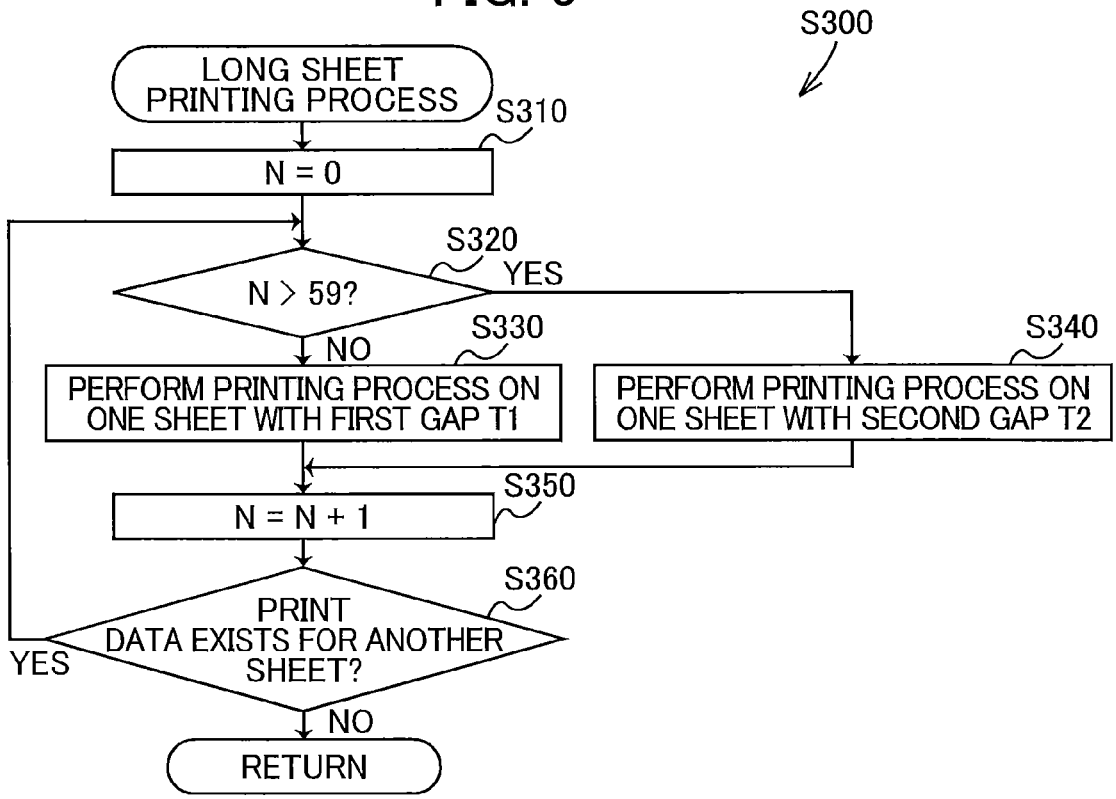
FIG. 5 is a flowchart illustrating steps in a long sheet printing process executed by the control unit of the image-forming apparatus according to the embodiment of the present disclosure.

FIG. 5 illustrates steps in the long sheet printing process of S300. In S310 of the long sheet printing process, the control unit 100 initializes a count N to zero. The count N represents the number of long sheets S that have been printed in succession. In S320 the control unit 100 determines whether the count N is greater than N1−1 obtained by subtracting one from the first number N1 of sheets S, i.e., fifty-nine.

If the control unit 100 determines that the count N is not greater than fifty-nine (S320: NO), in S330 the control unit 100 executes a printing process on the next sheet S while controlling the electromagnetic clutch 98 to maintain the sheet gap at the first gap T1. However, if the control unit 100 determines that the count N is greater than fifty-nine (S320: YES), in S340 the control unit 100 executes a printing process while controlling the electromagnetic clutch 98 to maintain the sheet gap at the second gap T2.

After completing the printing process for a single sheet S in S330 or S340, in S350 the control unit 100 increments the count N by one. In S360 the control unit 100 determines whether print data exists for another sheet.

If the control unit 100 determines that no print data remains (S360: NO), the control unit 100 ends the long sheet printing process. However, if the control unit 100 determines that print data exists for other sheets (S360: YES), the control unit 100 returns to S320 and continues the process described above.

According to the process described above, the image-forming apparatus 10 detects the length Ls of a sheet S being printed. When determining that the length Ls of the sheet S is longer than the long side in A4 size, the control unit 100 continues printing while maintaining the sheet gap at the first gap T1 until fifty-nine more sheets S have been printed (i.e., until a total of sixty sheets has been printed when the control unit 100 transitions to the long sheet printing process immediately after having printed the first sheet). After printing sixty sheets in succession including the first sheet, the control unit 100 changes the sheet gap from the first gap T1 to the larger second gap T2 for printing subsequent sheets. Accordingly, the control unit 100 can prevent overheating in the electromagnetic clutch 98 even when the length Ls of sheets S is longer than the prescribed length by reducing the duty cycle D for the electromagnetic clutch 98 after printing sixty sheets. Further, since the control unit 100 supplies power to the electromagnetic clutch 98 so that the sheet gap is maintained at the first gap T1 for up to 60 sheets, the control unit 100 can print rapidly despite the length Ls of the sheets S being longer than the prescribed length.

While the description has been made in detail with reference to a specific embodiment thereof, it would be apparent to those skilled in the art that many modifications and variations may be made thereto.

For example, when the length Ls of sheets S is longer than the prescribed length, the control unit 100 may supply power to the electromagnetic clutch 98 to convey the first number N1 of sheets S with the sheet gap set at the first gap T1, followed by conveying a single sheet with the sheet gap set at the second gap T2. Thereafter, the control unit 100 supplies power to the electromagnetic clutch 98 to alternate between conveying a second number N2 of sheets S at the first gap T1 and conveying a single sheet S at the second gap T2. The second number N2 of sheets S is an example of the second number of sheets of the present disclosure.

Figure 6:
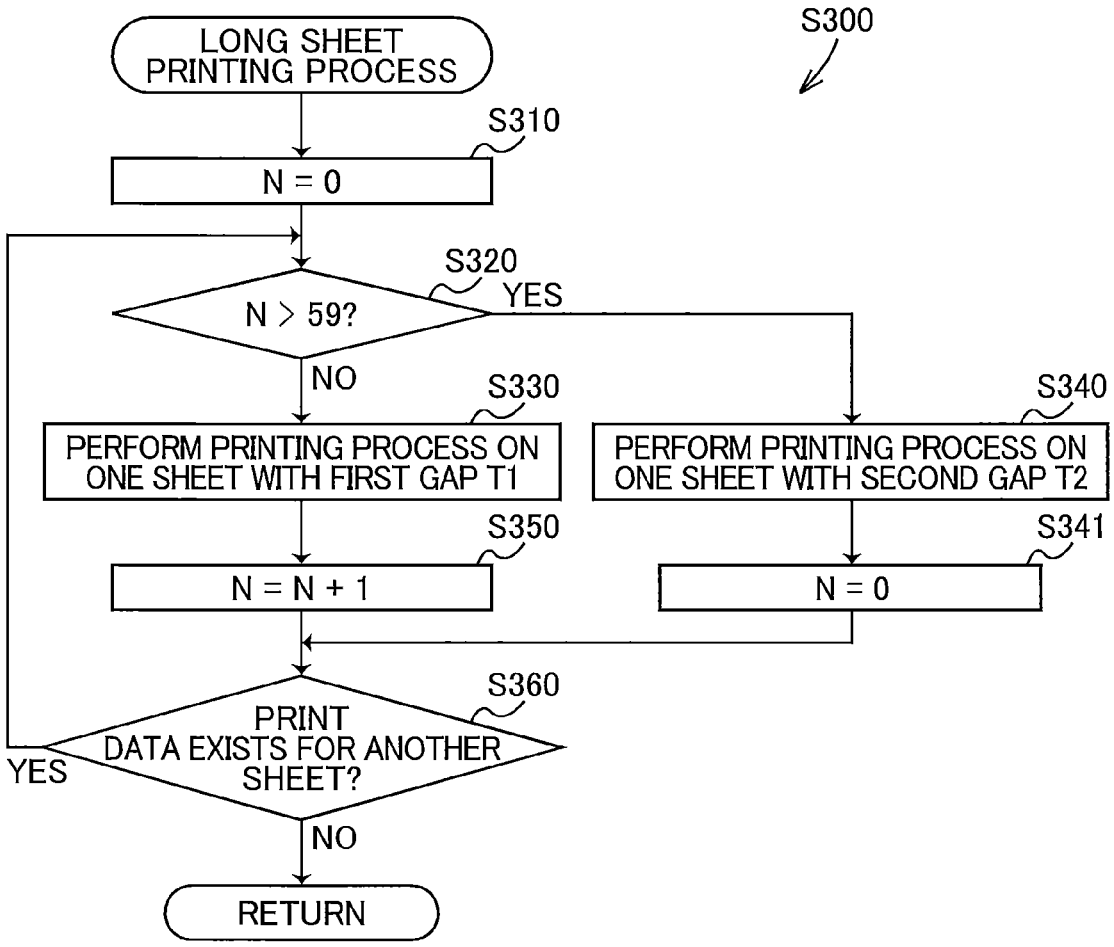
FIG. 6 is a flowchart illustrating steps in a long sheet printing process executed by a control unit of an image-forming apparatus according to a variation of the present disclosure.

FIG. 6 illustrates steps in the long sheet printing process of S300 according to this variation. In particular, after printing a sheet using the second gap T2 as the sheet gap (S340), in S341 the control unit 100 resets the count N to zero before advancing to S360. Through this process, the control unit 100 continues printing on long sheets using the first gap T1 as the sheet gap until the first number N1 of sheets S (sixty sheets) has been printed. After printing the first number N1 of sheets S in this way, the control unit 100 prints a single sheet S using the second gap T2 as the sheet gap. Thereafter, the control unit 100 sets the sheet gap to the second gap T2 after every time the second number N2 of sheets S (fifty-nine sheets) has been printed at the first gap T1. The second gap T2 used in this variation may be set longer to allow sufficient time for the temperature to drop in the electromagnetic clutch 98. Note that, in order to simplify the flowchart for this process, step S320 covers both the determination regarding whether the first number N1 of sheets S has been printed and the determination regarding whether the second number N2 of sheets S has been printed. However, the control unit 100 may be provided with separate counters and each determination may be performed using a different counter.

In the present embodiment described above, the control unit 100 acquires the length Ls for a sheet S according to signals received from the sheet sensor 90, but the control unit 100 may instead acquire the length Ls of a sheet S using the received print job. For example, the control unit 100 may extract the length Ls of the sheet from paper size information included in the print job.

The arrangement and configuration of the sheet sensor 90 are not limited to those described in the present embodiment.

In the present embodiment described above, the control unit 100 acquires the length Ls of a sheet S by conveying one sheet S and measuring the length Ls thereof with the sheet sensor 90. However, this method is merely an example of the present disclosure, and other methods may be used for acquiring the length of a sheet. For example, the image-forming apparatus may be provided with a sheet cassette having a sheet guide for aligning sheets in the sheet cassette, and may acquire the length of a sheet by detecting the position of the sheet guide. Further, the image-forming apparatus may acquire the length of a sheet by receiving user input therefor.

While a laser printer capable of only monochrome printing is used as an example of the image-forming apparatus in the present embodiment, the image-forming apparatus may be a printer capable of forming color images or may be a multifunction peripheral or a copy machine, for example. Further, the image-forming apparatus may form images according to another method, such as the inkjet method, and is not limited to the electrophotographic method.

The technical elements described in the above embodiment and its variations may be combined as appropriate.

What is claimed is:

1. An image-forming apparatus comprising:

a motor;

a conveying roller configured to convey a sheet in a conveying direction upon receipt of a drive force of the motor;

an image-forming portion configured to form an image on the sheet conveyed by the conveying roller;

an electromagnetic clutch configured to transmit the drive force of the motor to the conveying roller upon receipt of power; and a controller configured to:

control the conveying roller to successively convey a plurality of sheets to the image-forming portion; and control the image-forming portion to form an image on each of the plurality of sheets, the plurality of sheets including a first sheet and a second sheet to be successively conveyed to the image-forming portion following the first sheet, wherein in a case where a sheet length of the first sheet is shorter than or equal to a predetermined length:

the controller supplies power to the electromagnetic clutch to convey the first sheet and the second sheet to the image-forming portion so that a sheet gap in the conveying direction of the second sheet is equivalent to a first gap, the sheet gap of one sheet being a space formed between a trailing end of a previous sheet and a leading end of the one sheet, the previous sheet being successively conveyed prior to the one sheet, and wherein in a case where the sheet length of the first sheet is longer than the predetermined length:

the controller supplies power to the electromagnetic clutch to successively convey a first number of sheets starting from the first sheet to the image-forming portion so that the sheet gap of each of the first number of sheets is equivalent to the first gap; and after the first number of sheets has been conveyed to the image-forming portion, the controller supplies power to the electromagnetic clutch to convey at least one sheet to the image-forming portion so that the sheet gap of each of the at least one sheet is equivalent to a second gap greater than the first gap.

2. The image-forming apparatus according to claim 1, wherein in the case where the sheet length of the first sheet is longer than the predetermined length, after the first number of sheets has been conveyed to the image-forming portion, the controller supplies power to the electromagnetic clutch to convey all remaining sheets while maintaining the sheet gap of each of the all remaining sheets at the second gap.

3. The image-forming apparatus according to claim 1, wherein in the case where the sheet length of the first sheet is longer than the predetermined length, after the first number of sheets has been conveyed to the image-forming portion, the controller supplies power to the electromagnetic clutch to alternate between conveying a second number of sheets while maintaining the sheet gap of each of the second number of sheets at the first gap and conveying the at least one sheet while maintaining the sheet gap of each of the at least one sheet at the second gap.

4. The image-forming apparatus according to claim 1, wherein the conveying roller is a registration roller configured to correct skew in each of the plurality of sheets.

5. The image-forming apparatus according to claim 1, further comprising a sensor configured to detect passage of each of the plurality of sheets to output a signal, wherein the controller is further configured to:

acquire the sheet length according to the signal from the sensor.

6. The image-forming apparatus according to claim 1, wherein the controller is further configured to:

receive a print job; and acquire the sheet length from the print job.

7. The image-forming apparatus according to claim 1, wherein the controller is further configured to:

determine whether the sheet length of the first sheet in the conveying direction is longer than the predetermined length.

8. The image-forming apparatus according to claim 7, wherein the controller determines whether the sheet length of each of the plurality of sheets including the first sheet and a third sheet is longer than the predetermined length, the third sheet being to be conveyed to the image-forming portion after the first sheet is conveyed to the image-forming portion, and wherein in response to determining that the sheet length of the third sheet is longer than the predetermined length after determining that the sheet length of the first sheet is shorter than or equal to the predetermined length, the controller supplies power to the electromagnetic clutch to successively convey the first number of sheets starting from the third sheet to the image-forming portion while maintaining the sheet gap of each of the first number of sheets at the first gap, and after the first number of sheets have been conveyed to the image-forming portion, the controller supplies power to the electromagnetic clutch to convey at least one sheet to the image-forming portion while maintaining the sheet gap of each of the at least one sheet at the second gap.

9. The image-forming apparatus according to claim 1, wherein the controller is configured to switch the sheet gap between the first gap and the second gap by controlling a timing of supplying power to the electromagnetic clutch, and wherein a quantity of dissipated heat in the electromagnetic clutch per unit time is less when the plurality of sheets are conveyed to the image-forming portion while maintaining the sheet gap of each of the plurality of sheets at the second gap than when the plurality of sheets are conveyed to the image-forming portion while maintaining the sheet gap of each of the plurality of sheets at the first gap.

10. A sheet conveying method for conveying a plurality of sheets including a first sheet in an image-forming apparatus, the image-forming apparatus including a conveying roller, the sheet conveying method comprising:

when a length of the first sheet is shorter than or equal to a predetermined length:

conveying the plurality of sheets by the conveying roller such that a sheet gap between a trailing end of a previous sheet and a leading end of a subsequent sheet is equivalent to a first gap, the subsequent sheet being successively conveyed following the previous sheet;

when the length of the first sheet is longer than the predetermined length:

conveying a predetermined number of sheets by the conveying roller such that the sheet gap is equivalent to the first gap; and after conveying the predetermined number of sheets by the conveying roller successively conveying one or more sheets by the conveying roller such that the sheet gap is equivalent to a second gap longer than the first gap.

* * * * *